United States Patent [19]

Arasmith

[11] Patent Number: 4,793,341

[45] Date of Patent: Dec. 27, 1988

[54] UNDERWATER BREATHING APPARATUS HAVING A REPOSITORY

[76] Inventor: Stanley D. Arasmith, P.O. Box 2458, Rome, Ga. 30164-2458

[21] Appl. No.: 51,647

[22] Filed: May 20, 1987

[51] Int. Cl.[4] ..... B63C 11/16

[52] U.S. Cl. ..... 128/201.11

[58] Field of Search ..... 128/201.11, 201.27, 128/201.28

[56] References Cited

U.S. PATENT DOCUMENTS

| | | | |
|---|---|---|---|
| 46,902 | 3/1865 | Hawkins | 128/201.11 |
| 2,362,240 | 11/1944 | Bonilla | 128/201.11 |
| 2,753,865 | 7/1956 | Van Der Kogel | 128/201.11 |
| 2,975,439 | 3/1959 | Bentley | 128/201.11 |
| 3,370,586 | 2/1968 | Aragona | 128/201.11 |
| 4,061,148 | 12/1977 | Saito | 128/201.11 |

FOREIGN PATENT DOCUMENTS

| | | | |
|---|---|---|---|
| 927661 | 5/1947 | France | 128/201.11 |
| 712617 | 9/1966 | Italy | 128/201.11 |

*Primary Examiner*—Alan Cohan

*Attorney, Agent, or Firm*—Jones, Askew & Lunsford

[57] ABSTRACT

A double valved snorkel has an inlet tube with a mouthpiece intermediate the upper and lower ends of the inlet tube. An inlet valve is positioned adjacent to the upper end of the tube and admits air into the inlet tube upon a suction force being applied to the mouthpiece. A repository is positioned adjacent an exit valve at the lower end of the tube. A drain basin is positioned in the inlet tube above the mouthpiece and diverts moisture inside the tube toward the repository. Since the repository is adjacent the exit valve below the mouthpiece, all moisture in the repository is expelled through the exit valve when a swimmer or diver exhales through the mouthpiece.

11 Claims, 2 Drawing Sheets

UNDERWATER BREATHING APPARATUS HAVING A REPOSITORY

TECHNICAL FIELD

The present invention generally relates to underwater breathing apparatus, and more particularly relates to a snorkel construction which prevents large amounts of water from accumulating in the air intake passageway and expels inadvertently accumulated moisture from the snorkel.

BACKGROUND ART

Millions of people around the world enjoy swimming and other water sports and activities. Although many people enjoy the water, man is limited in his ability to fully enjoy the water because man is an air breathing animal. When submerged in water, man cannot breathe and thus his time submerged in the water is limited. In order to stay submerged for more than a minute or two, some type of underwater breathing equipment or apparatus is required.

For individuals, one type of underwater breathing apparatus is a snorkel, which is basically a tube, one end of which the swimmer or diver inserts into his mouth and the other end of which extends above the surface of the water so that the person may breathe in air while his face is submerged. This type of device extends the amount of time that a person may spend submerged. It is quite apparent that a snorkel is only useful when the swimmer or diver is close to the surface of the water since the depth to which he can submerge is limited by the length of the snorkel tube. The snorkel is still useful however for allowing a driver to swim beneath the surface of the water to any depth and then return near the surface of the water so that the snorkel once again extends above the surface of the water to take in a fresh supply of air. In this manner, the diver may keep his body submerged at all times while breathing in fresh air periodically.

Another type of underwater breathing apparatus is what is known as scuba gear. Unlike a snorkel, scuba gear includes an air supply which is typically stored in a tank which is worn around the swimmer's body. Since the air holding tank is worn on the swimmer's body it interferes with the mobility of the swimmer and is thus not always the most desirable piece of equipment. This is especially true where the depths to which the swimmer will dive are shallow so that a snorkel can be used. The snorkel is less obtrusive to the swimming activity than is the scuba gear.

Both snorkels and scuba gear are used by the swimmer for breathing. U.S. Pat. No. 46,902 which issued to J. Hawkins on Mar. 21, 1865 for Improved Submarine Safety Mouthpiece, U.S. Pat. No. 2,975,439 which issued to W. Bentley on Mar. 21, 1961 for Toy Scubas, U.S. Pat. No. 3,370,586 which issued to R. J. Aragonal et al on Feb. 27, 1968 for Underwater Breathing Device With Valved Float, and U.S. Pat. No. 4,061,140 which issued to M. Saito on Dec. 6, 1977 for Underwater Breathing Device, illustrate snorkel and scuba devices which contain a mouth piece which the diver inserts into his mouth to breathe through. The mouthpiece has one tube connected thereto through which air is inhaled and another tube connected thereto through which air is exhaled.

All of the breathing devices also seem to have in common the fact that moisture will tend to accumulate inside the mouthpiece and inside the tubes or water will enter through the tubes whenever the diver submerges the tubes below the surface of the water. While the tubes are not open for water to enter in scuba gear, moisture is still a by-product of breathing and the air in the tanks may contain some moisture which may accumulate and pose a problem. It is also possible for the mouthpiece to become dislodged from the mouth during swimming allowing water to enter. Also, water can enter through the mouth around the mouthpiece. So it is quite possible that moisture will be a problem.

Typically, the water accumulation problem has been approached by providing some sort of valve system in which there is a oneway valve connected with the inlet tube and another one-way valve connected with the outlet tube. The valves operate so that the inlet valve opens when it is desired to inhale air with the outlet valve remaining closed. When it is desired to exhale, the outlet valve opens allowing exhaled air to escape while the inlet valve remains closed. The inlet valve opens allowing air in but not allowing air out, while the outlet valve opens allowing air out but not allowing air in. Even with the valving system, when the snorkel tube becomes submerged water may leak through the valves and become a problem.

The water is usually removed by blowing through the mouthpiece which forces water out through the outlet valve. However, the prior art valves are often both located adjacent the mouthpiece, allowing the inlet tube to fill with water. Thus, water will remain in the breathing apparatus and will be drawn into the mouthpiece region when the diver inhales. Accordingly, it will be appreciated that it would be highly desirable to provide an underwater breathing apparatus which allows a swimmer to breathe while submerged while discouraging the entrance of water into the breathing apparatus but providing means for discharging any water that does enter.

SUMMARY OF THE INVENTION

Briefly stated, in accordance with one aspect of the invention, an underwater breathing apparatus includes an inlet tube having upper and lower ends and a mouthpiece connected to the inlet tube intermediate the upper and lower ends. The apparatus includes a repository for collecting fluid inside the inlet tube and positioning the fluid for expulsion in response to air pressure being exerted through the mouthpiece. Preferably, an inlet valve is positioned at the upper end of the inlet tube to prevent the inlet tube from being filled with water.

It is an object of a preferred embodiment of the present invention to provide a repository for collecting water which accumulates inside the tube so that it can be expelled. This object is achieved by forming a repository in the inlet tube adjacent an outlet valve at a location below the mouthpiece so that compression force, applied to the mouthpiece by exhaling, forces the water out the outlet valve. The air pressure exerted on the water in the tube is uniform over the surface of the water and forces virtually all of the water out the tube.

Another object of a preferred embodiment of the present invention is to direct water which inadvertently enters the inlet tube and travels down the tube away from the mouthpiece. The object is achieved by providing a basin defined along the inner surface of the inlet tube which collects water entering through the inlet valve and directs the water to the repository.

Still another object of a preferred embodiment of the present invention is to prevent the inlet tube from filling with water when a diver submerges. This object is achieved by locating the inlet valve adjacent the upper end of the inlet tube where it closes to prevent water from entering the tube. The inlet valve seals the upper end of the inlet tube and the outlet valve seals the lower end so that there is a pressure equilibrium which keeps the inlet valve closed even when the diver is submerged and water pressure acts to open the inlet valve.

Other aspects, objects and advantages of the present invention will become apparent upon reading the following detailed description of a preferred embodiment of the present invention when taken in conjunction with the drawings and appended claims.

DETAILED DESCRIPTION OF THE PREFERRED EMBODIMENTS

Figure 1:
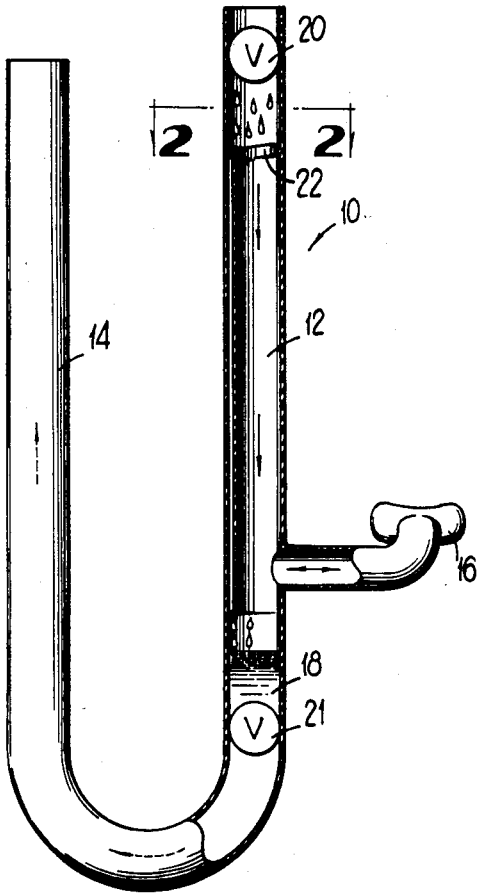
FIG. 1 is a diagrammatic longitudinal sectional view of a preferred embodiment of the present invention illustrating the relationship in a snorkel between the inlet tube, inlet and outlet valves and mouthpiece wherein the mouthpiece is situated such that a repository is formed below the mouthpiece in the inlet tube adjacent the outlet valve.

Referring to FIG. 1, an underwater breathing apparatus such as a snorkel 10 includes an inlet tube 12, an outlet tube 14, a mouthpiece 16, a repository 18, an inlet valve 20 and a outlet valve 21 which cooperate, as will be more fully explained hereinafter, to allow a person to breathe while his body is partially or totally submerged. A swimmer or diver positions his head so that he can place his mouth over the mouthpiece 16 for breathing. The mouthpiece 16 is connected to the inlet tube 12 at a location intermediate the ends of the tube 12. The swimmer breathes air in through the inlet valve 20 and inlet tube 12.

The inlet valve 20 is a one-way valve which is useful for duty in underwater environments such as this. A suitable valve may be a centrally anchored circular flap valve. The inlet valve 20 is a one-way valve which opens under suction pressure caused by inhalation to allow air to come into the inlet tube and then closes. The inlet valve 20 is normally closed and opens upon the demand of the diver to allow air to enter. Such a valve does not open when the diver exhales, as is the case with float valves sometimes used on snorkels. When the diver submerges and the inlet tube 12 is below the surface of the water, the valve remains closed against the pressure of the water because a counterbalancing water pressure acts upon the diver's lungs This creates a pressure equilibrium which negates the effect of the water pressure. As the water pressure on the valve increases, that same pressure acts to increase the air pressure within the inlet tube so that the valve remains closed. Although the valve 20 is biased to a closed position, it is preferred to have a valve which is not strongly biased to the closed position, so that the diver can breath naturally. The goal is to make breathing as natural and normal and easy as possible while preventing easy entry of water.

Similarly, the outlet valve 21 is a one-way valve which is normally closed and opens to allow exhaled air to exit from the mouthpiece 16 and inlet tube 12. The valves 20 and 21 may both be centrally anchored circular flap valves or they may be different valves. As mentioned, the inlet valve 20 controls the flow of fluid into the inlet tube 12 while the outlet valve 21 controls the flow of fluid into the outlet tube 14. Stated differently, the inlet valve 20 and outlet valve 21 respectively control the flow into and out of the inlet tube 12.

The mouthpiece 16 is connected to the inlet tube 12 at a position spaced apart from the outlet valve 21, such that the repository 18 is formed by the portion of the inlet tube 12 situated below the mouthpiece. The repository 18 is situated adjacent the outlet valve 21 at a position lower than the position of the mouthpiece 16 and the remainder of the inlet tube 12. In this manner, the repository 18 is at the lowest position on the upstream side of the outlet valve such that gravity operates to attract fluid from the inlet tube 12 and mouthpiece 16 to the repository. The repository is thus directly adjacent to the entrance of the exit tube and will have the water collected therein ready for expulsion whenever the one-way exit valve opens. Since the exit valve 21 is in a lower relative position than the repository 18, any water in the repository will be expelled into the exit tube 14 whenever oneway valve 21 opens. The one-way valve 21 will open whenever the swimmer exhales or whenever the swimmer blows into the mouthpiece to expel water.

The exit tube 14 as shown in FIG. 1 is lengthy in order to direct exhaust bubbles away from the user's face. However, the exit tube can terminate at any point down-stream of the outlet valve 21.

Figure 3:
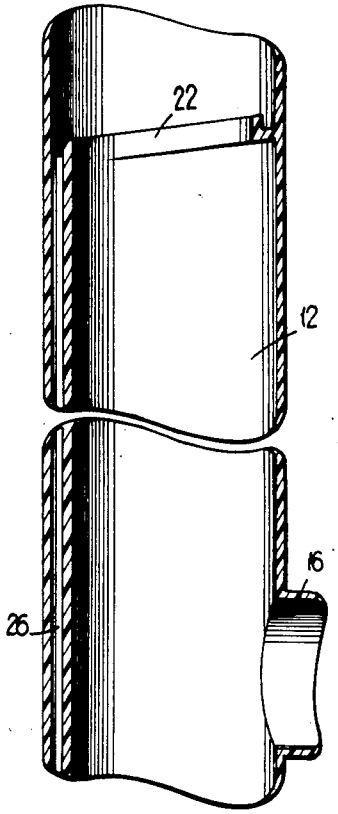
FIG. 3 is a longitudinal sectional view of a preferred embodiment of the present invention illustrating an integrally formed drain basin.
Figure 2:
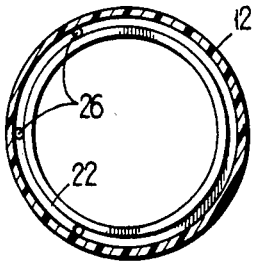
FIG. 2 is a diagrammatic cross sectional view taken along line 2—2 of FIG. 1 illustrating the basin and drain openings.
Figure 4:
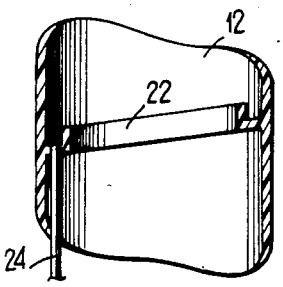
FIG. 4 is a longitudinal sectional view similar to FIG. 3 but illustrating another embodiment of the present invention.
Figure 5:
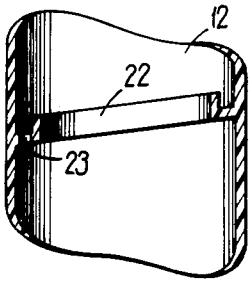
FIG. 5 is a longitudinal sectional view similar to FIGS. 3 and 4 but illustrating another embodiment of the present invention.

Referring to FIGS. 1-5, the inlet tube preferably contains a basin 22 which functions to divert water towards the repository and away from the mouthpiece 16. As is evident, any water which enters through one-way inlet valve 20 can travel down the interior walls of the inlet tube 12 and some of the water may eventually find its way into the mouthpiece 16. This is not a desired occurrence. To prevent the water from cascading down the interior walls of the inlet tube 12, a basin 22 is established which diverts the water towards the repository and away from the interior walls having the mouthpiece opening. The basin 22, in its simplest form, can be an annular ridge or protrusion which is angularly oriented on the interior of the inlet tube. Water which inadvertently enters the tube is directed down the ridge to the interior wall opposite the opening of the mouthpiece instead of travelling down the wall containing the opening of the mouthpiece (FIG. 5). In the embodiment shown in FIG. 5, a drain opening 23 empties the basin 22. In this manner the water is diverted to the farthest point away from the opening of the mouthpiece and is then free to travel into the repository which is at the lower elevation. It is also possible to form the basin such that the basin has a hose or drain tube 24 fitted to the opening 23. The hose 24 conducts moisture into the repository 18 (FIG. 4).

The snorkel is preferably constructed of modern plastic resinous materials and the basin 22 is preferably molded into the inlet tube 12. Where the construction is a molded construction, the drain line can also be molded into the sidewalls forming a vertical drain 26 (FIG. 3). In the preferred embodiment there is not a separate hose or line in the interior of the inlet tube to interfere with the passage of air (FIG. 3). There may be one such drain 26 or there may be a plurality of drains depending upon the physical dimensions of the inlet tube, the wall thicknesses and diameter of the drain.

Operation of the snorkel is believed to be apparent from the description above but a few words will be rendered for enlightenment. To use the snorkel, the diver simply inserts the mouthpiece into his mouth and breathes. A swimmer or diver accustomed to underwater breathing apparatus knows to breathe exclusively through his mouth. When this is done, the air entering the diver's lungs travels from the atmosphere above the surface of the water through inlet valve 20, inlet tube 12, mouthpiece 16 and into the diver's lungs. When the diver exhales, the exhaled air travels from his lungs through the mouthpiece 16, repository 18, one-way valve 21 into the exit tube 14, and is exhausted into the atmosphere or the water, depending on the length of the exit tube 14.

As it may sometimes happen, the diver may try to expel air at a time when the exhaust tube 14 is submerged. This presents no problem for the present invention. In such a case, the diver expels air from his lungs through the mouthpiece 16, through the repository 18, which at this point may or may not contain water, and through the one-way valve 21. Since the exhaust tube is submerged, water pressure acts on the exhaust valve 21 to keep it closed which will make it slightly harder for the diver to exhaust air through that valve. Such additional pressure does not present a problem. When the exit tube 14 becomes submerged, the diver is also submerged so that additional pressure on the one-way valve 21 caused by the water is equalized or offset by the water pressure acting upon the diver and therefore acting upon his lungs to maintain the balance on the one-way valve 21. Therefore, the diver simply breathes normally, expelling the air which forces the exit valve 21 to open and forces water accumulated in the exit tube to be exhausted into the body of water. When a diver takes a deep breath he expands his lungs to accommodate the extra air. When the diver contracts his lungs to exhale, the air is compressed in his lungs and exerts enough force to clear the exhaust tube.

Water inadvertently entering through the one-way valve 20 will begin to travel down the interior sidewall of the inlet tube 12 but will be diverted by the basin 22 away from the mouthpiece 16. Water gathering in the basin travels through the openings, drain tubes or the far sidewall of the inlet tube to the repository 18. The water collects in the repository until it is expelled through the exhaust valve 21. To breathe, the diver merely inserts the mouthpiece 16 into his mouth and inhales. When the diver inhales, he brings air from the atmosphere through the one-way valve 20, the inlet tube 12 and the mouthpiece into his lungs. Small amounts of water which inadvertently enter through the intake valve 20 are diverted by the basin to the repository 18. If the diver has been submerged, he instinctively knows when he has to clear the breathing apparatus before inhaling. The breathing apparatus is cleared by blowing on the mouthpiece. When the diver is submerged, his next normal breathing activity is exhaling. Normal exhaling upon surfacing is sufficient to clear the breathing apparatus. Blowing on the mouthpiece causes pressure to build up in the inlet tube and repository which forces the one-way valve 21 to open so that water which is in the inlet tube and repository can be expelled.

An advantage of the present invention is very apparent. Because the repository 18 is at a lower elevation and is adjacent to the exit valve 21, any fluid in the repository 18 is subject to the air pressure from the mouthpiece 16 so that all water in the repository 18 is expelled. No water remains in the repository once the expulsion process is completed. A small amount of air clears the tube preventing any large accumulation in the tube. The inlet valve is positioned at the top of the tube to prevent water from entering the tube. When submerged, the inlet valve is acted upon by pressure from the divers lungs to remain closed to keep water out.

Figure 6:
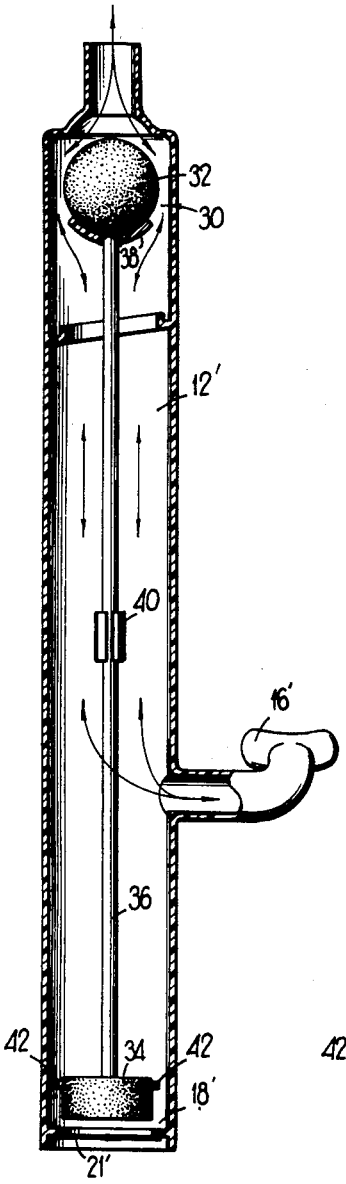
FIG. 6 is a diagrammatic longitudinal section view of another preferred embodiment of the present invention illustrating a snorkel which has increased fluid flow wherein the inlet valve is shown in the open position.
Figure 7:
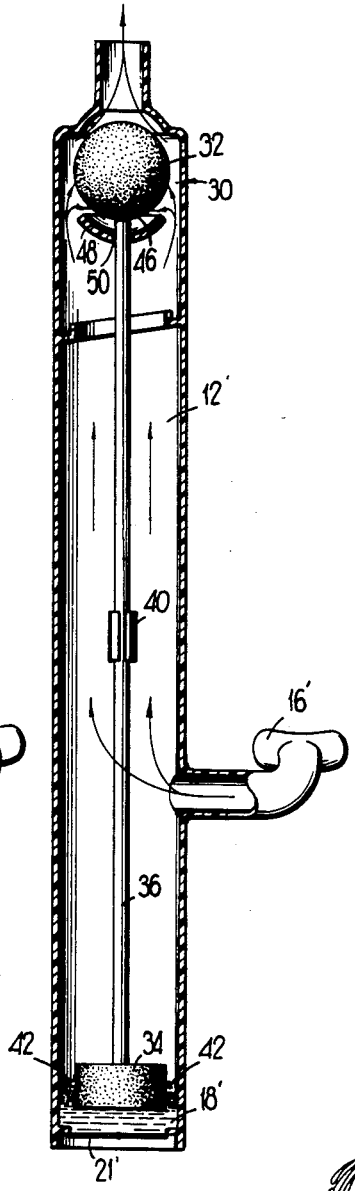
FIG. 7 illustrates the inlet valve of FIG. 6 at a position intermediate the open and closed positions.
Figure 8:
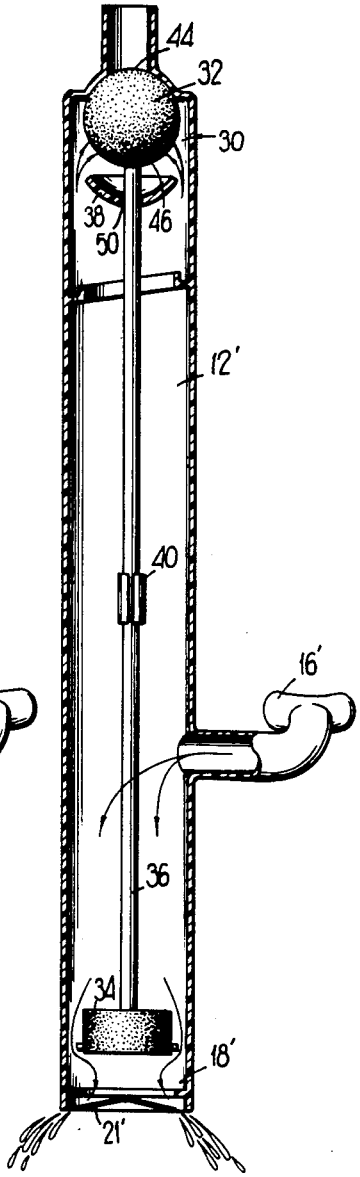
FIG. 8 illustrates the inlet valve of FIGS. 6 and 7 in the closed position.

Referring to FIGS. 6–8, another embodiment of the present invention is illustrated which utilizes an inlet valve means 30 which has the advantage of allowing a large air flow which is required by some swimmers and divers. The valve means or assembly 30 includes an inlet valve 32 at the upper end of an inlet tube 12' and a float 34 adjacent to an exhaust valve 21' at the repository end of the tube 12'. The valve 32 and float 34 are connected by an elongate rigid member 36. The inlet valve 32 preferably rests on a stop member 38 in the open position. The connecting member 36 passes slidably through an opening 50 in the stop member. One or more guides 40 are preferably provided for alignment of the inlet valve 32, rigid member 36 and float 34 in the inlet tube 12'. One or more float guides 42 may be used for alignment, either alone or in conjunction with the guide 40. The stop member 38, guides 40 and float guides 42 may be held in position by struts (not shown) extending to the interior walls of the inlet tube 12'. The valve means 30 may be used in conjunction with the directing means, which directs or diverts fluid travelling down the inlet tube away from the mouthpiece, such as the drain basin 22 hereinbefore described in conjunction with FIGS. 1–5.

The inlet valve 32 and float 34 are preferably constructed of a lightweight material such as cellular polystrene, for example, which is commonly sold under the trademark STYROFOAM. The rigid member 36 is preferably constructed of a lightweight water impervious material such as a lightweight plastic tube. Naturally, the float 34 must be sufficiently buoyant in water to cause the inlet valve 32 to move from the open position. The inlet valve 32 is operable between an open position at which the inlet valve 32 rests on the stop member 38 with fluid free to enter the upper end of the inlet tube 12' and a closed position at which the inlet valve 32 blocks the upper end of the inlet tube 12' preventing fluid from entering the inlet tube 12'. With this arrangement, the volume of fluid which can enter the tube 12' in the open position of the inlet valve 32 is limited only by the relative dimensions of the tube 12'.

If more air flow is desired, a larger inlet tube 12' is simply used.

The inlet valve 32 is preferably a ball type valve which has first and second surfaces 44 and 46. The float 34 is responsive to water in the repository 18' to move the inlet valve 32 from the open position thereby exposing the second surface 46 to the compression force which exists when the user exhales. At the open position, fluid is free to enter the upper end of the inlet tube 12' and the second surface 46 is blocked from exposure to the compression force. At the closed position, the first surface 44 of the inlet valve 32 engages the upper end of the tube 12' and the second surface 46 is exposed to the compression force. By this construction, an underwater breathing apparatus is formed which has an inlet tube 12' whose inlet valve 32 closes automatically when a certain amount of fluid collects in the repository 18' and which closes, under the influence of the compression force, when a minimal amount of fluid collects in the repository 18'.

Still referring to FIGS. 6–8, it is apparent that the stop member 38 is configured such that the second surface 46 of the inlet valve 32 is exposed to the compression force when the second surface 46 is raised from the stop member 38. This can be accomplished by configuring the stop member 38 with a concave semispherical mating surface 48 which has an opening 50. The compressed air which is exhaled from the diver's lungs enters through the opening 50 or around the member 38 to act on the second surface 46 which creates a greater pressure on the second surface 46 than on the first surface 44 creating a pressure imbalance causing the valve 32 to rise thereby moving toward the closed position.

Operation of the snorkel is easily described with reference to FIGS. 6, 7 and 8 illustrating the operating sequence as the valve moves from the open position to an intermediate position and finally to the closed position. First referring to FIG. 6, the valve assembly 30 is in the open position with the inlet valve 32 resting on the stop member surface 48 providing an open passageway from the atmosphere through the upper end of the inlet tube 12' to the mouthpiece 16' so that a diver can inhale and exhale in a normal fashion. As mentioned, the volume of air which the user can inhale is limited only be the relative dimensions of the upper end of the inlet tube 12' since, in the open position, the inlet valve 32 is completely free of the opening to the atmosphere. The air flows unrestrictedly around the ball shaped inlet valve 32 inside the inlet tube 12' on its way to the mouthpiece 16'. As illustrated, the outlet valve 21' is in the closed position. The float 34 is positioned in the inlet tube 12' in the repository 18' and may be in very close proximity to the outlet valve 21' or may be spaced therefrom a preselected distance. The space between the float 34 and the outlet valve 21' will determine the amount of water which can collect in the repository 18' before the valve assembly 30 reacts to it.

When the diver submerges, or when moisture otherwise enters through the top end of the inlet tube 12', the water finds its way to the repository 18'. When the water in the repository 18' reaches a certain level, the buoyancy of the float 34 causes the float 34 to rise which pushes upward on the connecting member 36 which pushes upward on the inlet valve 32 lifting it off the stop member 48. This exposes the second surface 46 of the inlet valve 32 as illustrated in FIG. 7. As the rigid member 36 moves upwardly, the guide member 40 helps maintain its vertical orientation. Similarly, when used, the guides 42 help maintain the horizontal position of the float 34 which also assists in maintaining the vertical orientation of the rigid member 36. It is important to maintain the vertical position of the rigid member 36 and the horizontal position of the float 34 so that the amount of water in the repository 18', which causes a selected amount of vertical movement of the inlet valve 32, can be determined with precision. Although the valve assembly 30 will work satisfactorily whether the members maintain close alignment or not, tilting of the members may allow the same amount of water in the repository 18' to cause different amounts of movement of the inlet valve 32, which is not preferred.

Referring now to FIG. 7, water in the repository 18' has acted on the float 34 causing the inlet valve 32 to lift from the stop member 48 exposing the second surface 46 to the compression force. It is noted at this point that it does not matter what conditions existed prior to arrival at the point illustrated in FIG. 7. The result will be the same. If the diver is submerged, the diver is holding his breath so that there is no compression force and water can continue to enter the inlet tube 12' until a level in the repository 18' is reached which buoys the float 34 sufficiently to close the inlet valve 32. Since the diver is holding his breath, his next breathing action is to exhale which creates the compression force which acts on the second surface 46 of the inlet valve 32 forcing the inlet valve 32 to remain closed as illustrated in FIG. 8. At the same time the compression force opens the outlet valve 21' so that accumulated fluid in the repository 18' can be expelled.

Again referring to FIG. 7, if the diver is not submerged, as would be the case if the diver had been submerged and has just surfaced, his next breathing activity is again to exhale causing the inlet valve 32 to close and the outlet valve 21' to open as before. If, on the other hand, the diver has not been submerged but has been breathing normally through the mouthpiece 16', he inhales normally, causing air to enter his lungs and causing any fluid which may enter the inlet tube 12' to be deposited in the repository 18'. However, when the diver exhales, he forces the inlet valve 32 to close and the exit valve 21 to open expelling the accumulated moisture from the repository 18'.

It should now be apparent, that the amount of water which can enter the inlet tube 12' is limited. When the water level in the repository 18' rises to buoy the float 34 sufficiently, the valve 32 will close preventing additional water from entering the upper end of the inlet tube 12'. This occurs even when the diver is trying to breathe normally, thereby preventing the diver from taking water into his lungs. If the inlet valve 32 closes when the diver is inhaling, the diver will stop inhaling and exhale forcing the exit valve 21' to open expelling moisture which is accumulated in the repository 18'. The diver can then try to inhale. If water still enters, the valve 32 will again close when the water level in the respository 18' reaches the predetermined level. This prevents the diver from inhaling water. If the diver is not submerged but has water entering the tube, operation is the same. If the water level becomes sufficient, the inlet valve 32 will close and will remain closed until the water is expelled through the outlet valve 21 by the compression force. After expelling the water from the repository 18', the diver can inhale normally unless water again enters into the repository 18' to trigger closing of the inlet valve 32. Thus, the snorkel is effective in extremely choppy water and could even be used in a waterfall which has a mixture of water and air. The snorkel will allow the user to take in air into his lungs without taking in water also.

It will now be understood that there has been presented an underwater breathing apparatus which is simple to operate. The apparatus generally prevents water from filling the air inlet tube, and diverts water which inadvertently enters the inlet tube away from the mouthpiece. The apparatus contains a repository which accumulates moisture and positions it for complete expulsion from the mouthpiece and inlet tube when the diver blows or exhales through the mouthpiece. The apparatus is designed to prevent water from entering the inlet tube and to divert water which inadvertently enters the inlet tube away from the mouthpiece and toward the repository.

As will be evident from the foregoing description, certain aspects of the invention are not limited to the particular details of the examples illustrated, and it is therefore contemplated that other modifications or applications will occur to those skilled in the art. For example, while the invention has been described in detail for a snorkel, it is apparent that the same structure may be equally applicable to any underwater breathing apparatus or other breathing apparatus which has a double valve construction. It is accordingly intended that the claims shall cover all such modifications and applications as do not depart from the true spirit and scope of the invention.

What is claimed is:

1. An underwater breathing apparatus, comprising:
an inlet tube having an upper end and a lower end;
a mouthpiece connected to said inlet tube intermediate the ends thereof;
inlet valve means positioned adjacent to said upper end of said inlet tube for admitting fluid into said inlet tube upon suction force being applied to said mouthpiece; and
outlet valve means positioned adjacent to the lower end of said inlet tube for allowing fluid to escape from said inlet tube upon compression force being applied to said mouthpiece;
said inlet tube defining a fluid repository between said mouthpiece and said outlet valve.

2. The apparatus of claim 1, further comprising means for directing fluid travelling down said inlet tube away from said mouthpiece.

3. The apparatus of claim 2, wherein said directing means comprises an annular basin defined along an inner surface of said inlet tube, and means for conducting said fluid from said basin to said repository.

4. The apparatus of claim 3, wherein said annular basin is angularly oriented with a portion on the inner surface nearest said mouthpiece being positioned closer to the upper end of the inlet tube than other portions of said basin.

5. The apparatus of claim 3 wherein said basin is integrally formed in a sidewall of the inlet tube.

6. The apparatus of claim 1 wherein said inlet tube, mouthpiece and repository are in continuous fluid communication.

7. An underwater breathing apparatus, comprising:
an inlet tue having an upper end and a lower end;
a mouthpiece connected to said inlet tube intermediate the ends thereof;
outlet valve means positioned adjacent to the lower end of said inlet tube for allowing fluid to escape from said inlet tube upon compression force being applied to said mouthpiece;
said inlet tube defining a fluid repository between said mouthpiece and said outlet valve; and
inlet valve means positioned adjacent to said upper end of said inlet tube for admitting fluid into said inlet tube upon suction force being applied to said mouthpiece;
said inlet valve means comprising;
an inlet valve operable between an open position at which fluid is free to enter said upper end of said inlet tube and a closed position at which said inlet valve blocks said upper end of said inlet tube preventing fluid from entering; and
means responsive to water in said repository, for moving said inlet valve from the open position toward the closed position.

8. The apparatus of claim 7 wherein said moving means includes a float and a rigid member connecting the float and inlet valve whereby movement of said float in response to an increase in water in said respository acts through said rigid member moving said inlet valve from the open position towards the closed position.

9. The apparatus of claim 8 wherein moving said inlet valve from the open position exposes a surface of said inlet valve to said compression force, which acts on said exposed surface thereby closing said inlet valve.

10. The apparatus of claim 7 including means for supporting said inlet valve in said open position.

11. An underwater breathing apparatus, comprising:
an inlet tube having an upper end and a lower end;
a mouthpiece connected to said inlet tube intermediate the ends thereof;
outlet valve means positioned adjacent to the lower end of said inlet tube for allowing fluid to escape from said inlet tube upon compression force being applied to said mouthpiece;
said inlet tube defining a fluid repository between said mouthpiece and said outlet valve; and
inlet valve means positioned adjacent to said upper end of said inlet tube for admitting fluid into said inlet tube upon suction force being applied to said mouthpiece;
said inlet valve means comprising:
an inlet valve having first and second surfaces and being movable between an open position at which fluid is free to enter said upper end of said inlet tube and said second surface is blocked from exposure to said compression force, and a closed position at which said first surface sealingly engages said upper end of said inlet tube and said second surface is exposed to said compression force; and
flotation means, responsive to water in said repository, for moving said inlet valve from the open position thereby exposing said second surface to said compression force.

* * * * *